US012089715B2

(12) United States Patent
Bickford et al.

(10) Patent No.: US 12,089,715 B2
(45) Date of Patent: Sep. 17, 2024

(54) ADJUSTABLE COSMETIC ASSEMBLIES AND APPLICATORS

(71) Applicant: L'Oreal, Paris (FR)

(72) Inventors: William Bickford, Scotch Plains, NJ (US); Michael P. Robinson, II, Brooklyn, NY (US); Oliver Sha, Fort Lee, NJ (US); Lemis Tarajano, Brooklyn, NY (US)

(73) Assignee: L'Oreal, Paris (FR)

( * ) Notice: Subject to any disclaimer, the term of this patent is extended or adjusted under 35 U.S.C. 154(b) by 960 days.

(21) Appl. No.: 16/779,458

(22) Filed: Jan. 31, 2020

(65) Prior Publication Data

US 2021/0235843 A1 Aug. 5, 2021

(51) Int. Cl.
*A45D 34/04* (2006.01)

(52) U.S. Cl.
CPC ..... *A45D 34/04* (2013.01); *A45D 2200/1018* (2013.01); *A45D 2200/1036* (2013.01)

(58) Field of Classification Search
CPC ..... A45D 34/04; A45D 2200/1018; A45D 2200/1036; A45D 33/34; A45D 33/36; A45D 37/00; A45D 2040/0012; A45D 2200/1009; A45D 2200/1054; A45D 33/02; A45D 33/025; A45D 33/22; A45D 33/18; A45D 33/16; A45D 2034/005; A45D 2034/007; A61M 35/006; A61M 35/003; A47K 7/00; A47K 7/028; A47K 7/03
USPC ..... 132/320; 220/780; 401/183–186; 15/245
See application file for complete search history.

(56) References Cited

U.S. PATENT DOCUMENTS 532,245 A * 1/1895 Petterson ..... A45D 40/24 24/537
816,227 A * 3/1906 Fosberg ..... G02C 13/006 15/214
938,421 A * 10/1909 Hakins ..... A47L 13/257 15/244.1

(Continued)

FOREIGN PATENT DOCUMENTS

EP 1195105 A1 4/2002
FR 2869205 B1 6/2006

(Continued)

OTHER PUBLICATIONS

Preliminary Search Report and Written Opinion for FR2003505 mailed Nov. 23, 2020, 6 pages.

*Primary Examiner* — Jacqueline T Johanas
*Assistant Examiner* — Holly T. To
(74) *Attorney, Agent, or Firm* — Christensen O'Connor Johnson Kindness PLLC

(57) ABSTRACT

Cosmetic assemblies are movable between a resting state and a compressed state. The cosmetic assemblies include an applicator and an actuator. The applicator is at least partially formed of a compressible material that is biased toward the resting state, and the actuator is configured to actuate the applicator between the resting state and the compressed state. In the resting state, the applicator displaces a first volume and has a first outer dimension. In the compressed state, the applicator displaces a second volume that is less than the first volume, and the applicator has a second outer dimension that corresponds to and exceeds the first outer dimension.

9 Claims, 8 Drawing Sheets

(56) References Cited

U.S. PATENT DOCUMENTS 1,059,440 A * 4/1913 Coochrane ..... G02C 13/006 15/214
1,326,265 A * 12/1919 Hobbs ..... A47K 7/03 401/207
1,355,026 A * 10/1920 Austin ..... A46B 11/0013 401/278
1,439,734 A * 12/1922 Guinzburg ..... A45D 33/34 15/229.14
1,560,061 A * 11/1925 Kish ..... B43K 5/04 401/230
1,630,437 A * 5/1927 Kjellstrom ..... A45D 33/02 132/307
1,631,791 A * 6/1927 Buckley ..... A61H 13/00 15/210.1
1,644,377 A * 10/1927 Heilbron ..... A45D 33/025 132/298
1,692,876 A * 11/1928 Volckening ..... A45D 33/34 132/301
1,749,052 A * 3/1930 Watt ..... A46B 15/00 15/184
1,934,681 A * 11/1933 Damsel ..... B65D 59/00 220/780
2,022,896 A * 12/1935 Nathans ..... A45D 40/26 401/35
2,055,314 A * 9/1936 Seburger ..... G02C 13/006 401/206
2,136,779 A * 11/1938 Bednar ..... A45D 40/26 132/218
2,204,605 A * 6/1940 Landsman ..... A45D 33/34 401/200
2,446,653 A * 8/1948 Kelly ..... A47L 13/022 15/229.13
2,554,489 A * 5/1951 Crane ..... A45D 33/005 137/454.2
2,658,221 A * 11/1953 Nicoli ..... A47L 4/02 15/244.1
2,705,499 A * 4/1955 Breeze ..... A45D 24/22 15/210.1
2,718,980 A * 9/1955 Strom ..... B65D 43/0212 220/780
2,776,667 A * 1/1957 Fitz Gerald ..... A45D 7/04 15/210.1
2,819,484 A * 1/1958 Fouse ..... A47L 4/02 15/220.3
2,908,923 A * 10/1959 Schlechter ..... G02C 13/006 24/561
2,927,335 A * 3/1960 Hammond ..... A47J 43/28 401/184
2,961,677 A * 11/1960 Zecchini ..... A47L 23/10 401/196
2,979,757 A * 4/1961 Smith ..... A47L 13/22 401/206
3,014,579 A * 12/1961 Lathrop ..... A45D 29/007 132/73
3,023,886 A * 3/1962 Abrams ..... B65D 77/02 206/823
3,064,301 A * 11/1962 Clor ..... A45D 34/04 15/210.1
3,205,527 A * 9/1965 Laird ..... A47L 17/00 15/210.1
3,320,993 A * 5/1967 Motsenbocker ... B65D 43/0212 220/780
3,337,895 A * 8/1967 Clements ..... A45D 33/34 428/101
3,357,395 A * 12/1967 Lorber ..... B43M 11/04 401/196
3,402,417 A * 9/1968 Lund ..... B05C 17/00 15/210.1
3,450,140 A * 6/1969 Vail ..... A45D 19/028 132/212
3,472,242 A * 10/1969 Demner ..... A61Q 1/14 D28/8
3,488,126 A * 1/1970 Avallone ..... A47K 7/028 510/142
3,572,349 A * 3/1971 Slemmons ..... A45D 40/26 132/216
3,636,922 A * 1/1972 Ketner ..... A61K 8/0208 604/289
3,876,314 A * 4/1975 Nehring ..... A61M 35/006 604/289
4,031,853 A * 6/1977 Conrad ..... B41J 31/14 15/104.93
4,078,792 A * 3/1978 Arato ..... A63H 33/00 239/211
4,126,962 A * 11/1978 Polcaro ..... A47L 25/00 15/210.1
4,140,409 A * 2/1979 DeVries ..... A45D 34/04 604/289
4,417,826 A * 11/1983 Floros ..... A46B 13/06 401/184
4,428,388 A * 1/1984 Cassai ..... A46B 9/021 D28/7
4,475,835 A * 10/1984 Verboom ..... A47L 13/17 401/196
4,478,530 A * 10/1984 Van Overloop .... A61M 35/006 401/196
4,545,393 A * 10/1985 Gueret ..... A46B 9/021 132/218
4,557,620 A * 12/1985 Hancy ..... B44D 3/22 401/184
4,598,723 A * 7/1986 Cole ..... A46B 9/021 132/218
4,823,985 A * 4/1989 Grollier ..... A61Q 5/10 222/105
4,963,045 A * 10/1990 Willcox ..... A45D 34/04 401/184
4,963,047 A * 10/1990 Trotta ..... A46B 5/0033 401/281
4,982,751 A * 1/1991 Oishi ..... A45D 33/02 206/823
4,995,344 A * 2/1991 Olson ..... A01K 13/002 119/603
5,087,138 A * 2/1992 Terbrusch ..... A45D 34/04 401/206
5,181,531 A * 1/1993 Escoto ..... A46B 11/0003 132/308
5,222,268 A * 6/1993 Snodgrass ..... A46B 5/002 15/160
5,397,194 A * 3/1995 Yuan ..... A47L 13/17 401/266
5,457,842 A * 10/1995 Chang ..... G02C 13/006 15/214
5,704,723 A * 1/1998 Salisian ..... A47K 7/03 401/8
5,904,151 A * 5/1999 Gueret ..... A45D 40/00 401/266
5,957,142 A * 9/1999 Karafilis ..... A45D 40/30 132/285
6,017,162 A * 1/2000 Call ..... A45D 34/041 401/6
6,223,787 B1 * 5/2001 Graham ..... A45D 33/34 141/2
6,283,128 B1 * 9/2001 Saxton ..... A45D 2/18 132/246
6,287,612 B1 * 9/2001 Mandava ..... B65D 81/32 206/568
6,293,286 B1 * 9/2001 Gueret ..... A45C 13/008 220/849
6,325,564 B1 * 12/2001 Knowles ..... A45D 34/042 401/289
6,339,860 B1 * 1/2002 Chen ..... G02C 13/006 15/220.3
6,601,591 B1 * 8/2003 Carullo ..... A45D 40/00 132/320
6,609,526 B2 * 8/2003 Yuhara ..... A45D 33/02 132/307
6,676,320 B1 * 1/2004 Wainer ..... A46B 9/021 401/121

(56) References Cited

U.S. PATENT DOCUMENTS 6,726,386 B1 * 4/2004 Gruenbacher ..... B65D 81/3266 401/133
6,811,338 B1 * 11/2004 Manske, Jr. ..... A47L 13/19 401/133
7,021,848 B1 * 4/2006 Gruenbacher ..... A47L 13/19 126/263.08
7,066,675 B1 * 6/2006 Miller ..... A45D 29/007 401/126
7,108,440 B1 * 9/2006 Gruenbacher ..... A47L 13/19 401/133
7,422,389 B2 * 9/2008 Abergel ..... A45D 34/041 401/218
7,461,992 B2 12/2008 Griffon
D627,930 S * 11/2010 Gold ..... D28/63
8,025,453 B2 * 9/2011 Chan ..... B60S 3/047 401/262
8,047,213 B2 * 11/2011 Yasuda ..... A45D 40/262 15/160
8,123,073 B2 * 2/2012 LaFlamme ..... G01F 11/025 401/184
8,267,609 B2 * 9/2012 Levine ..... A61M 35/003 433/89
8,343,014 B2 * 1/2013 Findeisen ..... A61F 5/019 601/40
8,393,043 B2 * 3/2013 Limongi ..... A45D 33/36 132/320
8,408,218 B2 * 4/2013 Anderson ..... A45D 40/18 132/218
9,201,252 B2 * 12/2015 Anderson ..... G02C 13/006
9,801,460 B2 * 10/2017 Lim ..... A46B 9/021
11,432,687 B1 * 9/2022 Kowalski ..... A47K 7/03
2005/0056343 A1 * 3/2005 Gueret ..... A45D 40/262 141/349
2005/0097694 A1 * 5/2005 Michaels ..... A47K 11/10 15/210.1
2005/0201812 A1 * 9/2005 Wong ..... A46B 11/0003 401/7
2005/0249539 A1 * 11/2005 Habatjou ..... A45D 40/265 401/126
2005/0273962 A1 * 12/2005 Dillon ..... A46B 9/10 15/169
2006/0021991 A1 * 2/2006 Liu ..... B65D 43/0212 220/780
2006/0110208 A1 * 5/2006 Tsaur ..... B65D 39/00 401/185
2006/0248785 A1 * 11/2006 Shelton ..... A45D 24/30 43/132.1
2007/0045448 A1 * 3/2007 Albisetti ..... B05B 11/043 239/323
2007/0144550 A1 * 6/2007 Roher ..... A45D 19/016 132/208
2007/0172305 A1 * 7/2007 Altonen ..... A45D 34/04 401/262
2007/0295350 A1 * 12/2007 Shelton ..... A01M 3/04 132/137
2008/0039812 A1 * 2/2008 Kang ..... A45D 40/0087 604/385.02
2008/0138142 A1 * 6/2008 Pressman ..... C09D 5/20 401/183
2009/0263176 A1 * 10/2009 Mileti ..... A46B 11/0065 401/184
2010/0239353 A1 * 9/2010 Prax ..... A45D 34/04 401/133
2011/0052306 A1 * 3/2011 Cavaiani ..... A46B 11/0079 222/105
2011/0088712 A1 * 4/2011 Pires ..... A61C 5/60 401/121
2011/0100392 A1 * 5/2011 Smith ..... A45D 44/12 132/320
2011/0183296 A1 * 7/2011 Levine ..... A61C 5/62 433/80
2012/0037180 A1 * 2/2012 Rossi ..... A45D 40/26 132/320
2012/0160262 A1 * 6/2012 Tranchant ..... A45D 40/267 401/129
2012/0180808 A1 * 7/2012 Nakamura ..... A45D 40/26 132/320
2012/0192885 A1 * 8/2012 Shelton ..... A01M 3/04 132/200
2012/0201593 A1 * 8/2012 Priore ..... A45D 40/265 401/122
2012/0204899 A1 * 8/2012 Uehara ..... A45D 40/262 132/320
2013/0104921 A1 * 5/2013 Shammami ..... A45D 29/007 132/73
2013/0114989 A1 * 5/2013 McNamara ..... A45D 40/265 401/130
2013/0121752 A1 * 5/2013 Byun ..... A46B 7/023 401/269
2014/0196234 A1 * 7/2014 Lim ..... A46B 5/005 15/160
2014/0311511 A1 * 10/2014 Cox ..... A45D 33/34 156/60
2014/0331429 A1 * 11/2014 Lim ..... A45D 33/00 15/190
2015/0053222 A1 * 2/2015 Stoplos-Schaffer ..... A45D 29/007 132/73
2015/0296965 A1 * 10/2015 Peskin ..... A46B 15/0095 15/171
2016/0113375 A1 * 4/2016 Lim ..... A45D 33/36 401/118
2017/0224098 A1 * 8/2017 Jones ..... A46B 9/021
2017/0231363 A1 * 8/2017 Herrera ..... A45D 34/04 132/320
2018/0255908 A1 * 9/2018 Wightman ..... A45D 40/262
2018/0360188 A1 * 12/2018 Quagliara ..... A45D 29/007
2019/0059548 A1 * 2/2019 Chaillet-Piquand ... A45D 33/34
2019/0159572 A1 * 5/2019 Tarajano ..... A61M 35/003
2020/0046102 A1 * 2/2020 Silva ..... B32B 7/12
2020/0121057 A1 * 4/2020 Wong ..... A46B 5/0095
2020/0170377 A1 * 6/2020 Tarajano ..... A45D 34/042
2020/0170379 A1 * 6/2020 Bickford ..... A45D 40/28
2020/0187623 A1 * 6/2020 Tammel ..... A45D 40/26
2020/0205552 A1 * 7/2020 Shadduck ..... A45D 34/04
2020/0237086 A1 * 7/2020 Crapet ..... A46B 1/00
2021/0076806 A1 * 3/2021 Taylor ..... A45D 40/26
2021/0179332 A1 * 6/2021 Lyons ..... B65D 75/56
2022/0112022 A1 * 4/2022 May ..... B65D 35/28
2022/0160094 A1 * 5/2022 Lyons ..... A45D 2/48

FOREIGN PATENT DOCUMENTS

FR 3109071 A1 * 10/2021 ..... A45D 34/04
GB 940620 A * 10/1963
GB 2160105 A * 12/1985 ..... A45D 34/041
JP 2013176498 A 9/2013
KR 20130122560 A 11/2013
KR 20130122560 U 11/2013
KR 20160093351 A * 8/2016
WO WO-03076000 A1 * 9/2003 ..... A45D 34/04
WO WO-2014002006 A1 * 1/2014 ..... A45D 34/04
WO WO-2017108587 A1 * 6/2017
WO 2017171319 A1 10/2017
WO WO-2019121265 A1 * 6/2019 ..... A45D 34/045

* cited by examiner

ADJUSTABLE COSMETIC ASSEMBLIES AND APPLICATORS

SUMMARY

The present disclosure provides applicators (e.g., cosmetic applicators) having adjustable geometry, and adjustable cosmetic assemblies that enable a user to dynamically adjust the geometry of such applicators.

In an aspect, the present disclosure provides cosmetic assemblies that are movable between a resting state and a compressed state. The cosmetic assemblies include an applicator and an actuator. The applicator is at least partially formed of a compressible material that is biased toward the resting state, and the actuator is configured to actuate the applicator between the resting state and the compressed state. In the resting state, the applicator displaces a first volume and has a first outer dimension. In the compressed state, the applicator displaces a second volume that is less than the first volume, and the applicator has a second outer dimension that corresponds to and exceeds the first outer dimension.

In some embodiments, the actuator includes a threaded mechanism configured to compress the applicator in the compressed state. In some embodiments, the threaded mechanism is connected to a handle configured to actuate the threaded mechanism. In some embodiments, the threaded mechanism is connected to a first end of the handle, and a second end of the handle is provided with a second applicator.

In some embodiments, the actuator is configured to compress the applicator between two grasping surfaces. In some embodiments, the applicator has a hole or aperture receiving the actuator therethrough. In some embodiments, the applicator has a toroidal shape. In some embodiments, the two grasping surfaces connect through the hole of the applicator. In some embodiments, the two grasping surfaces connect through the hole of the applicator with a mechanism that enables relative movement between the two grasping surfaces (e.g., relative axial movement). In some embodiments, the actuator has an offset connector that connects the two grasping surfaces.

In some embodiments, the applicator is substantially solid.

In some embodiments, the applicator is substantially hollow and includes at least one air chamber.

In some embodiments, the applicator has an outer shape that is multi-lobal, elliptical, oval, circular, crescent-shaped, rectangular, hexagonal, or octagonal.

In some embodiments, the compressible material includes at least one material selected from: a thermoset plastic, a silicone, a rubber, a thermoplastic elastomer, a thermoplastic vulcanizate, a thermoplastic urethane, or a gel based polymer.

In some embodiments, an internal volume of the applicator is sealed.

In some embodiments, the cosmetic assembly includes a formulation.

In some embodiments, the actuator is formed as a single molded part.

In another aspect, the present disclosure provides an applicator configured to be actuated by a cosmetic assembly that is movable between a resting state and a compressed state. The cosmetic assembly has an actuator configured to actuate the applicator between the resting state and the compressed state. The applicator includes an applicator body at least partially formed of a compressible material that is biased toward the resting state. In the resting state, the applicator displaces a first volume, and in the compressed state, the applicator displaces a second volume that is less than the first volume.

In some embodiments, the compressible material includes at least one material selected from: a thermoset plastic, a silicone, a rubber, a thermoplastic elastomer, a thermoplastic vulcanizate, a thermoplastic urethane, or a gel based polymer.

In some embodiments, the applicator body has a hole therethrough configured to receive the actuator of the cosmetic assembly.

BRIEF DESCRIPTION OF THE SEVERAL VIEWS OF THE DRAWINGS

The foregoing aspects and many of the attendant advantages of the claimed subject matter will become more readily appreciated by reference to the following detailed description, when taken in conjunction with the accompanying drawings, wherein:

DETAILED DESCRIPTION

The present disclosure provides applicators (e.g., cosmetic applicators) having adjustable geometry, and adjustable cosmetic assemblies that enable a user to dynamically adjust the geometry of such applicators. This adjustability, coupled with a flexibility and shape of the applicator, allows the user to change the volume of the applicator, allowing a multitude of application possibilities in relation to the contours of the face (forehead, cheek, chin, eye, skin, lip areas), neck, and other parts of the body.

In the following description, numerous specific details are set forth in order to provide a thorough understanding of one or more embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

Figure 1A:
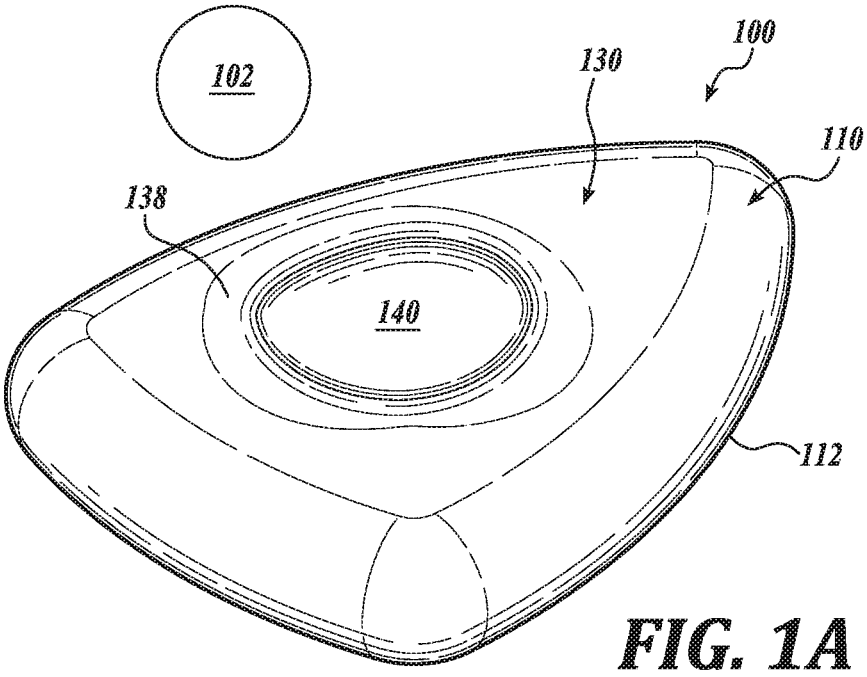
FIG. 1A shows an upper perspective view of a cosmetic assembly in accordance with a representative embodiment of the present disclosure.

FIG. 1A-FIG. 1D show a representative cosmetic assembly 100 according to the present disclosure. The cosmetic assembly 100 is one example of a dynamically-adjustable device that greatly facilitates the efficiency and efficacy with which a user can apply an optional formulation 102, for example liquid formulations, powder formulations, gels, creams, lotions, or any number of other formulations common to the cosmetic/personal care industries. In particular, the cosmetic assembly 100 is a useful tool configured to apply formulation 102 to a skin portion of the body. However, the cosmetic assembly 100 is useful even without the formulation 102, for example to dab, wipe, blot, exfoliate, or condition a skin portion. To clarify, in some embodiments, the cosmetic assembly 100 includes the formulation 102; however, in other embodiments, the cosmetic assembly 100 does not include the formulation 102. In the embodiment of FIG. 1A, the formulation 102 is shown as separate from the cosmetic assembly 100 (e.g., as part of a kit or sold separately); however, in some embodiments, the formulation 102 is provided within the cosmetic assembly 100, e.g., as a formulation infused and/or loaded in an applicator (as shown in FIG. 2B), or as a formulation-containing vessel stored within the cosmetic assembly (as shown in FIG. 3A).

In the non-limiting embodiment of FIG. 1A-FIG. 1D, the cosmetic assembly 100 includes two primary elements: an applicator 110 and an actuator 130. The actuator 130 is configured to act on the applicator 110 such that the cosmetic assembly 100 is movable between a resting state and a compressed state, described in detail below. In some embodiments, the cosmetic assembly 100 includes a vessel configured to contain the formulation 102 and to dispense the formulation 102 into the applicator 110, for example a vessel positioned within the applicator 110 or the actuator 130. In some embodiments, the cosmetic assembly 100 includes one or more additional elements, for example one or more exchangeable applicators 110, each of which may be well-suited to a different purpose (e.g., applying formulation to the eyes or the neck).

Applicator 110 is a pad, blender, brush, or similar flexible applicator body at least partially formed of a compressible material and configured for contact with a skin portion of a user. Further, the applicator 110 is configured for reversible movement between the resting state and the compressed state. In the resting state, the applicator 110 displaces a first volume, and in the compressed state, the applicator 110 displaces a second (compressed) volume that is less than the first volume. As used herein, the term "volume" generally refers to a total displacement of the applicator, i.e., the three dimensional space occupied by the applicator 110 up to its outer surface 112.

Suitable compressible materials for applicator 110 include resilient materials such as thermoset plastics, silicones, natural or synthetic rubbers (e.g., NBR or EPDM), thermoplastic elastomers (TPE), thermoplastic vulcanizates (TPV), thermoplastic urethanes (TPU), gel based polymers, polymers produced through additive manufacturing (AM), or other flexible materials used in cosmetic and personal care packaging. In some embodiments, the applicator 110 is a consumable component configured to be disposable and replaced periodically.

In some embodiments, the applicator 110 is substantially solid, e.g., a closed cell foam EPDM material. In some embodiments, the applicator 110 is an open cell foam or polymer, or a substantially solid but flexible material (like a solid elastomer or solid rubber). As used herein, a portion of applicator 110 is substantially solid if the solid volume of the applicator 110 occupies substantially more volume than any voids of the applicator 110. For example, an open-cell or closed-cell foam applicator 110 may be substantially solid despite the existence of one or more relatively small voids or chambers formed within.

Figure 2A:
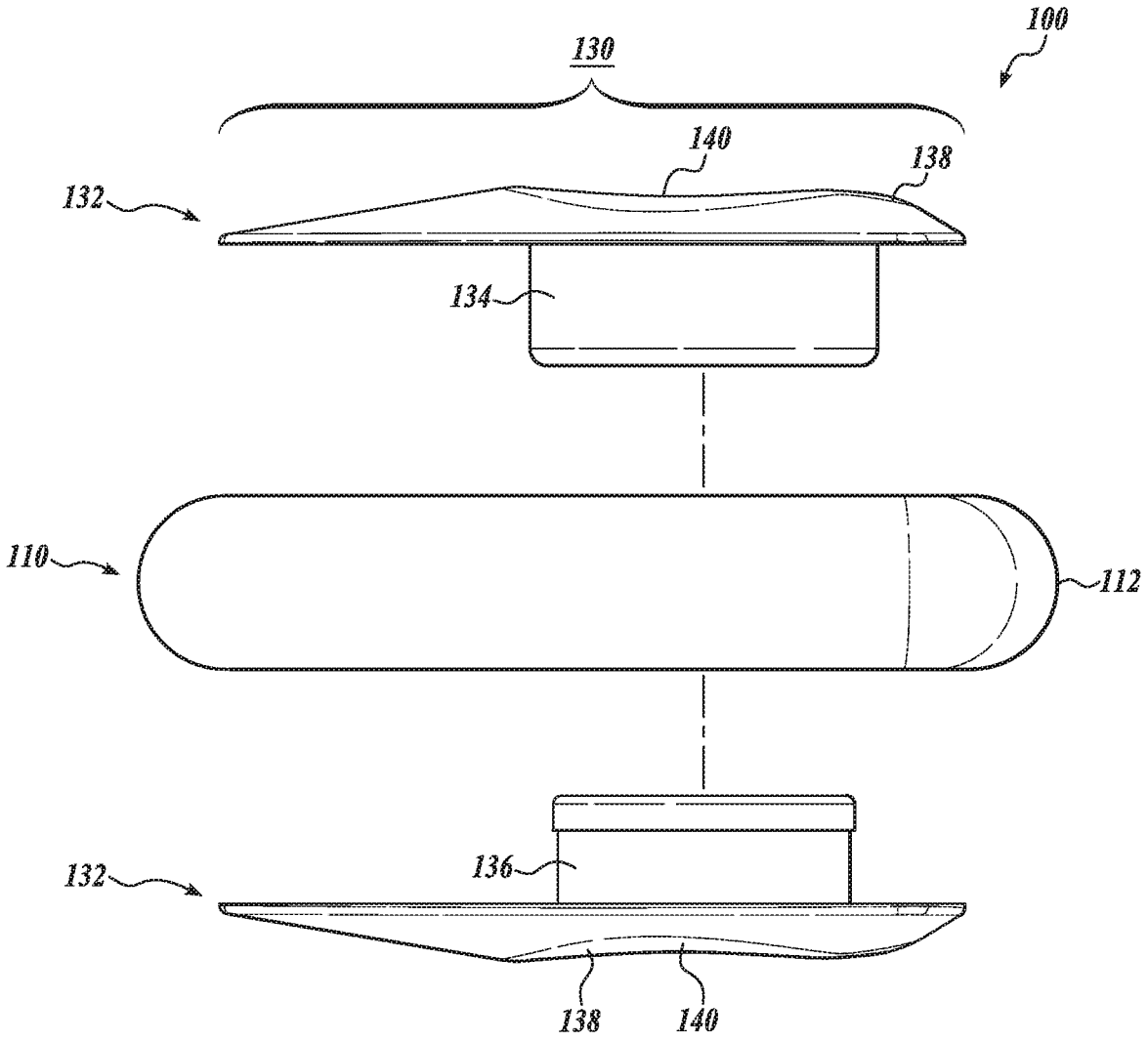
FIG. 2A shows an exploded side elevation view of the cosmetic assembly of FIG. 1A.
Figure 2B:
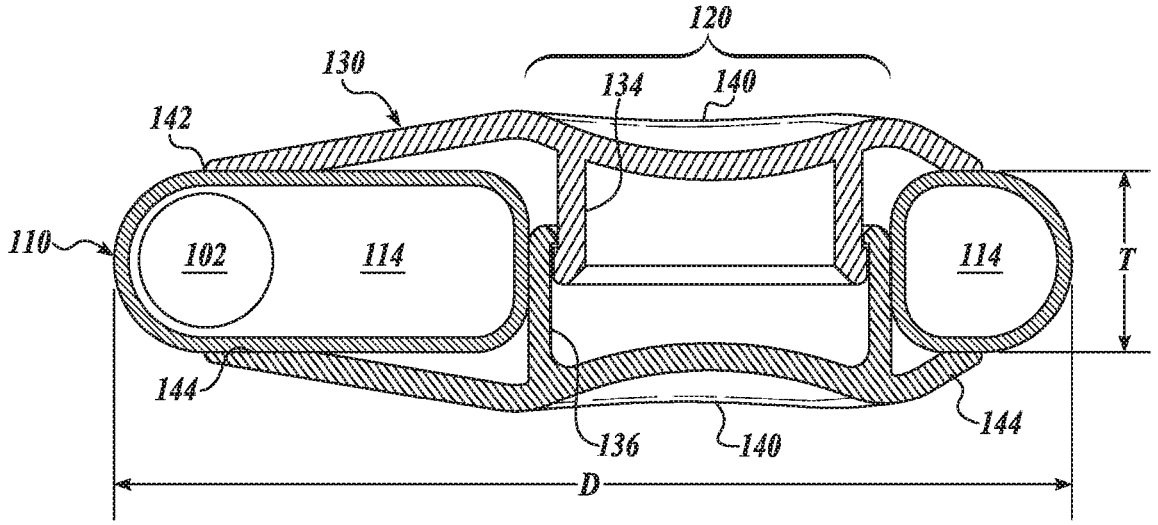
FIG. 2B shows a side elevation section view of the cosmetic assembly of FIG. 1A, in a resting state.
Figure 2C:
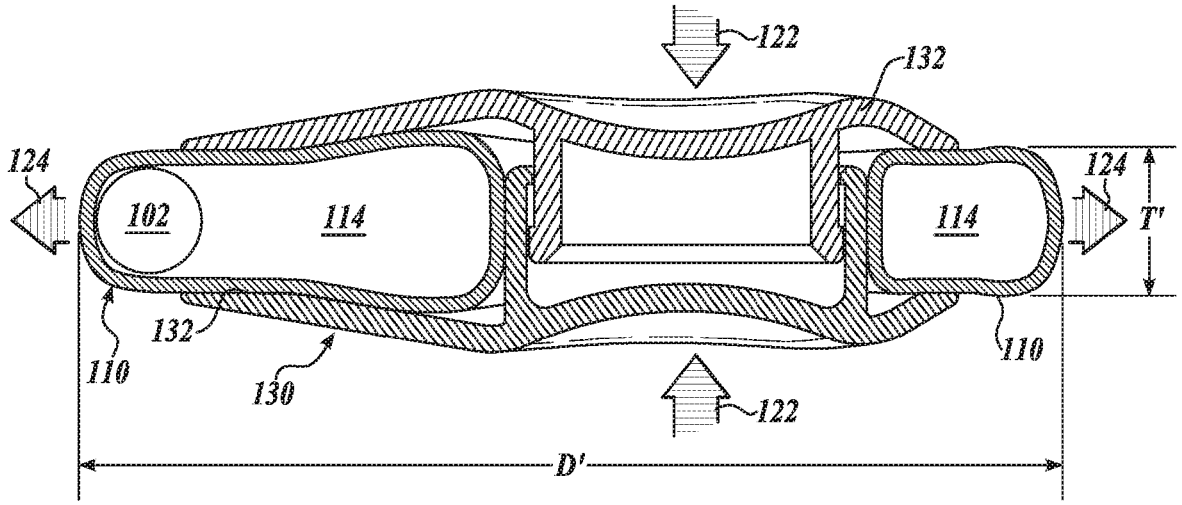
FIG. 2C shows a side elevation section view of the cosmetic assembly of FIG. 1A, in a compressed state.
Figure 3A:
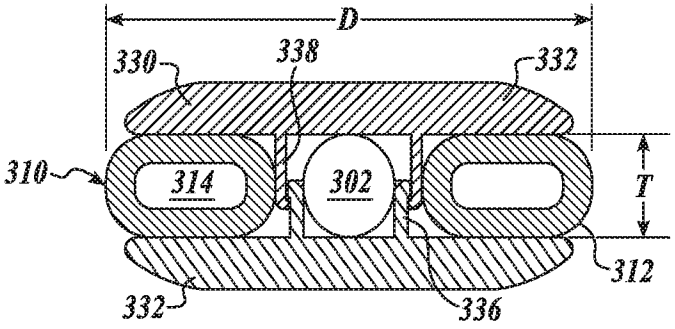
FIG. 3A shows a side elevation section view of a cosmetic assembly in accordance with another representative embodiment of the present disclosure, in a resting state.

In some embodiments (such as shown in FIG. 2B-FIG. 2C), the applicator 110 is at least partially hollow, i.e., includes at least one relatively large air chamber 114 formed therein, which may be at least partially filled with air or another gas. The term "air chamber" is not intended to limit the voids of applicator 110 to those filled with air, per se. In some embodiments, the gas-filled air chamber 114 is sealed (like a balloon or bladder). In some embodiments, the applicator 110 has one or more holes or perforations. In some embodiments, the applicator 110 has one or more intake valves and/or check valves to enable the selective introduction and/or removal of gas from within the applicator 110.

Figure 1B:
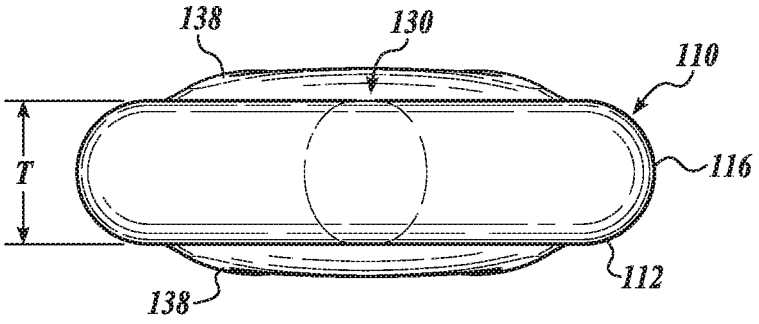
FIG. 1B shows a front elevation view of the cosmetic assembly of FIG. 1A.

Referring to FIG. 1B, the applicator 110 has a thickness T that can range from about 0.01 mm (e.g., at an edge portion 116 in precision applicators) to about 50.0 mm (e.g., in body applicators). In some embodiments, the thickness T varies at one or more locations of the applicator 110. For example, referring to FIG. 1C, in some embodiments the applicator 110 has a first thickness at a first lobe portion 118 (e.g., about 0.01 mm to about 0.50 mm), and a second thickness at another lobe portion 118 (e.g., about 0.50 mm to about 20 mm). In some embodiments, the thickness of the applicator 110 varies at one or portions located inward from the edge portion 116, for example to provide a recess configured to accommodate the actuator 130.

The outer surface 112 of the applicator 110 can have one or more portions that are smooth, texturized with one or more textures, or have any combination thereof. The surface characteristics of the outer surface 112 can be selected and configured to assist the application of the formulation 102 to a skin portion. For example, in some embodiments, the outer surface 112 is texturized, e.g., one or more portions of the outer surface 112 has kullenschliff, a Granton edge, dimples, and/or similar surface features that advantageously reduce friction. In some embodiments, one or more portions of the outer surface 112 have surface features configured to increase friction, such as an exfoliating surface treatment. In some embodiments, at least a portion of the outer surface 112 changes texture between the resting state and the compressed state.

In FIG. 1A-FIG. 1D, the applicator 110 (and in particular its outer surface 112) has a trilobal outer shape, i.e., three lobe portions 118. However, as will become apparent from the representative embodiments described herein, the shape of the applicator 110 can vary considerably between cosmetic assemblies of the present disclosure. In some embodiments, the applicator 110 has an outer shape that is multi-lobal, elliptical, oval, circular, crescent-shaped, rectangular (e.g., squared), hexagonal, octagonal, or another outer shape. In some embodiments, the applicator 110 has a number of lobe portions or protrusions, e.g., one, two, three (as in FIG. 1A-FIG. 1D), four, five, or more lobe portions and/or protrusions.

Figure 1D:
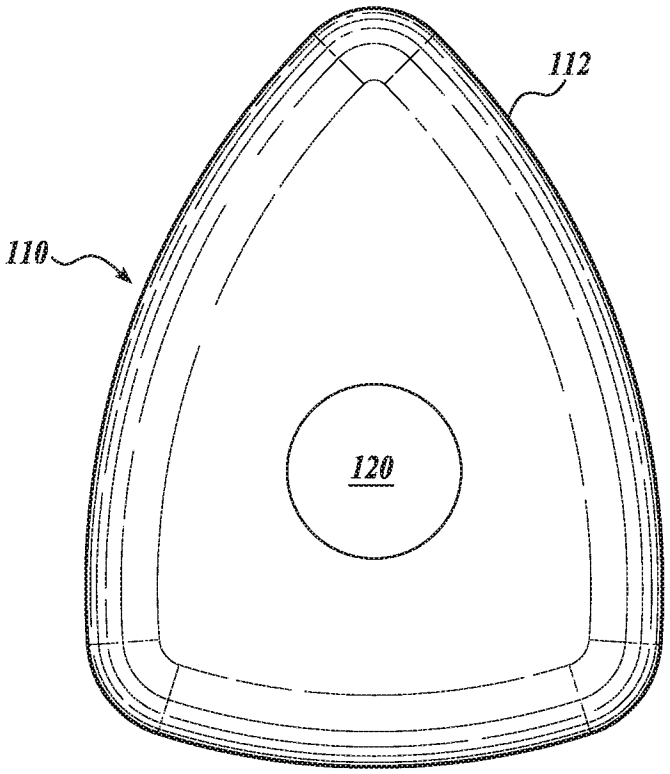
FIG. 1D shows top plan view of an applicator of the cosmetic assembly of FIG. 1A.
Figure 1C:
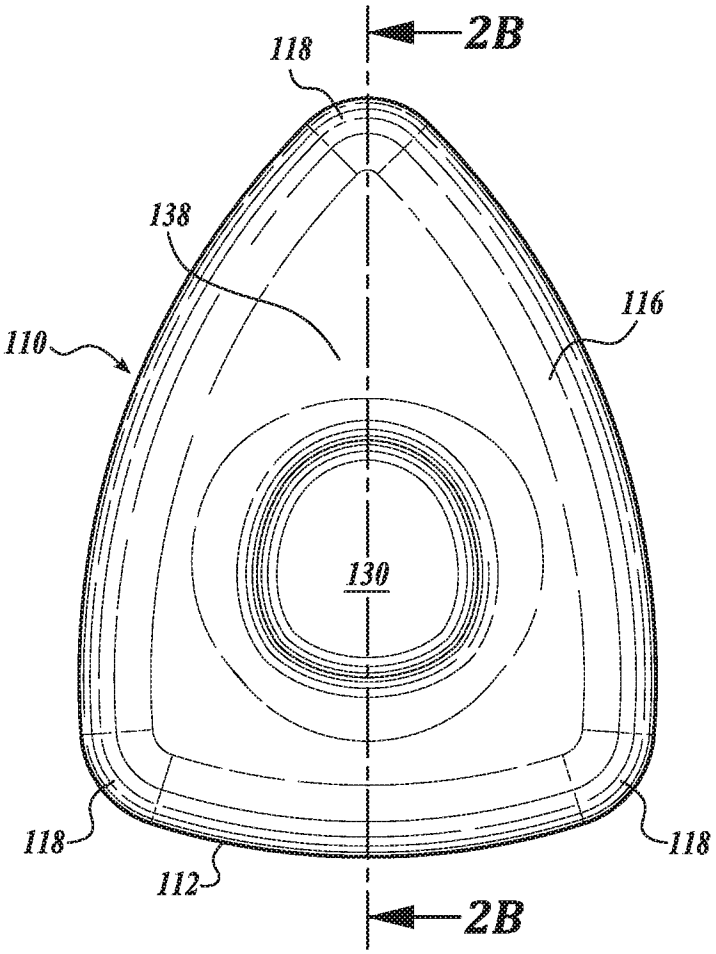
FIG. 1C shows a top plan view of the cosmetic assembly of FIG. 1A.

As shown in FIG. 1D, the applicator 110 has a toroidal shape, i.e., a surface of revolution with a hole 120 in the center. As described with respect to FIG. 2A-FIG. 2C, this hole 120 is utilized in some embodiments to receive a portion of the actuator 130. In some embodiments, the hole 120 receives a vessel that stores formulation 102. In some embodiments, the applicator 110 does not have a hole 120, for example as described with respect to the embodiments of FIG. 3A-FIG. 3D and FIG. 5A-FIG. 5B. As used herein, the term "toroidal" is not intended to limit the present disclosure to applicators that are symmetrical about an axis of revolution; rather, the term "toroidal" refers to applicators having a hole therethrough.

FIG. 2A-FIG. 2C illustrate details of the actuator 130, as well as movement of the cosmetic assembly 100 between the resting state (shown in FIG. 2B) and the compressed state (shown in FIG. 2C). Generally, the actuator 130 moves and "actuates" the applicator 110 between the resting state and the compressed state.

The actuator 130 includes a plurality of actuator parts 132 that couple together in a movable configuration. In this non-limiting example, the two actuator parts 132 slidably couple together through the hole 120 of the applicator 110 such that one actuator part 132 is configured to slide axially relative to another actuator part 132 while remaining connected thereto. That is, the actuator 130 includes a piston 134 and a piston sleeve 136 with the latter being sized and shaped to slidably receive the former through the hole 120 of the applicator 110. In some embodiments, the actuator parts 132 couple together with a threaded assembly to enable precise adjustment of force on the applicator 110 and to enable the actuator 130 to apply a constant force to the applicator 110, in order to hold the cosmetic assembly 100 in the compressed state or in an intermediate state.

The actuator parts 132 are configured to assemble as a permanent assembly in the illustrated embodiment (e.g., with a snap fit); however, in some embodiments, the actuator parts 132 are configured to be disassembled from one another. Further, the present disclosure is not limited to actuators 130 having a piston assembly; other representative actuators include: actuators formed of substantially a single molded element (such as the offset connector-type actuator of FIG. 4A-FIG. 4D; actuators utilizing different movement assemblies (such as the threaded mechanism of FIG. 5A and FIG. 5B); and other actuators configured to actuate the applicator 110 between the resting state and the compressed state.

Each actuator part 132 has a grasping surface 138 configured to facilitate use of the cosmetic assembly 100, in particular the actuation of the cosmetic assembly 100 between the resting state and the compressed state. In the illustrated representative embodiment, each grasping surface 138 is provided with a depression 140 for this purpose. In some embodiments, at least a portion of one or more grasping surfaces 138 is provided with a texture, e.g., to improve user feel and/or to make the cosmetic assembly 100 easier to hold. Further, edges 142 of each grasping surface 138 taper "downward" toward the applicator 110 in the illustrated embodiment, such that the edges 142 form a smooth transition to the applicator 110. Further still, in some embodiments, a size (thickness) of applicator contact portions 144 of one or more edges 142 is sized and shaped such that the actuator 130 exerts an appropriate pressure on the applicator 110.

For the sake of understanding different representative embodiments, FIG. 2B and FIG. 2C shows the optional formulation 102 as loaded into the applicator 110. To clarify, other than the placement of formulation 102, FIG. 1A-FIG. 2C show the same embodiment. In one representative embodiment, formulation 102 is a liquid formulation and applicator 110 is at least partially formed from a foam material, and the formulation 102 is provided in the foam material such that it is released upon movement of the cosmetic assembly 100 to the compressed state.

Comparing FIG. 2B with FIG. 2C, differences between the resting state (FIG. 2B) and the compressed state (FIG. 2C) are evident. Firstly, the two actuator parts 132 translate toward each other in an axial direction 122 as the cosmetic assembly 100 moves from the resting state to the compressed state. Referring to FIG. 2C, this translation of the actuator parts 132 in the axial direction 122 causes the edges 142 of the actuator 130 to compress the applicator 110 and the air chamber 114 contained therein. Consequently, pressure within the air chamber 114 increases, and the applicator 110 compensates by expanding in a radially outward direction 124. The radially outward direction 124 is representative. In some embodiments, the applicator 110 expands in a different direction in the compressed state.

The geometry of the applicator 110 changes between the resting state and the compressed state. The cosmetic assembly 100 is configured to be adjusted along a continuum between the resting state and the compressed state, such that a user can tailor the geometry of the applicator 110. In the resting state (FIG. 2B), the applicator 110 has a first outer dimension D (e.g., a circumference, perimeter, diameter, cross sectional area, or the like), and in the compressed state (FIG. 2C), the applicator 110 has a second outer dimension D' that corresponds to and exceeds the first outer dimension D. Although the outer dimension Dis shown increasing in both radially outward directions 124 in FIG. 2C, in some embodiments, the outer dimension D increases in substantially one dimension. In some embodiments, the outer dimension D increases in more than one dimension. Further, in the resting state, the applicator 110 has a first thickness T, and in the compressed state, the applicator 110 has a second thickness T' that corresponds to and is less than the first thickness T.

Because there is generally an inverse relationship between volume and density of the applicator 110, moving the cosmetic assembly 100 from the resting state towards the compressed state causes the density of the applicator 110 to increase (i.e., the applicator 110 feels firmer). One the one hand, the greater softness of the applicator 110 (e.g., in the resting state) generally enables a user to apply formulation to a larger skin portion as compared to the compressed state. For example, the resting state may be useful for applying a powder cosmetic formulation to a cheek skin portion or neck skin portion. On the other hand, the greater firmness of the applicator 110 (e.g., in the compressed state) generally enables a user to apply formulation with greater precision than in the resting state, such as to a smaller skin portion. For example, the compressed state may be useful for blending eye makeup on an eye skin portion. Thus, in some embodiments, in the resting state, the applicator 110 has a first density, and in the compressed state, the applicator 110 has a second density that exceeds the first density. In some embodiments, in the resting state, the applicator 110 a first internal pressure, and in the compressed state, the applicator 110 has a second internal pressure that exceeds the first volume.

Pressure within the air chamber 114 and material properties of the applicator 110 resists movement toward the compressed state, such that the applicator 110 is biased toward the resting state in the illustrated embodiment; consequently, the cosmetic assembly 100 is biased toward the resting state and advantageously provides feedback to a user via actuator 130. In some embodiments, the air chamber 114 is sealed (like a balloon or bladder) such that it is biased toward the resting state via pressure. In some embodiments, the applicator 110 has one or more holes or perforations, and thus is biased toward the resting state by the mechanical properties of the applicator material. In some embodiments, the actuator 130 (e.g., a spring or hinge thereof) biases the cosmetic assembly 100 toward the resting state.

FIG. 3A-FIG. 3D show another representative cosmetic assembly 300 formed in accordance with the present disclosure. The cosmetic assembly 300 is similar to the cosmetic assembly 100 of FIG. 1A-FIG. 2C. The cosmetic assembly 300 includes a toroidal applicator 310 having a hole 320 that receives an actuator 330 therethrough. Further, the applicator 310 is substantially hollow and has an air chamber 314 formed therein. The actuator 330 includes two actuator parts 332, each including part of a coupling assembly, i.e., a piston assembly in this embodiment. That is, one actuator part 332 includes a piston 336, while the other actuator part 332 includes a piston sleeve 338 configured to slidably receive the piston 336.

Figure 3B:
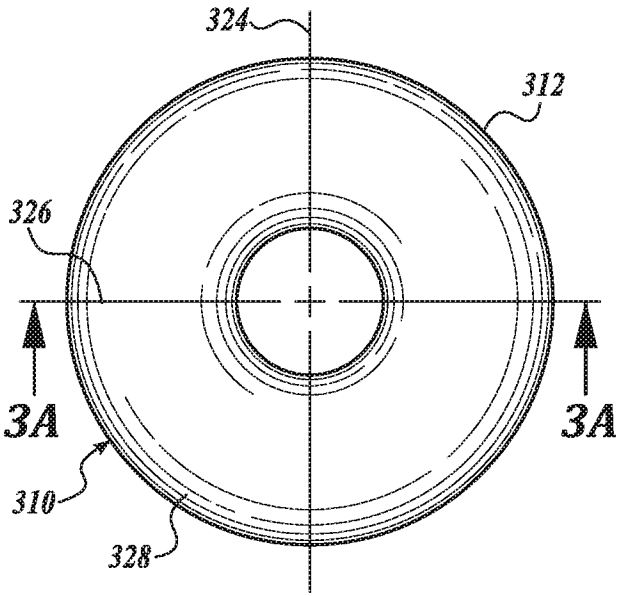
FIG. 3B shows a schematic top plan view of the cosmetic assembly of FIG. 3A, in the resting state.
Figure 3C:
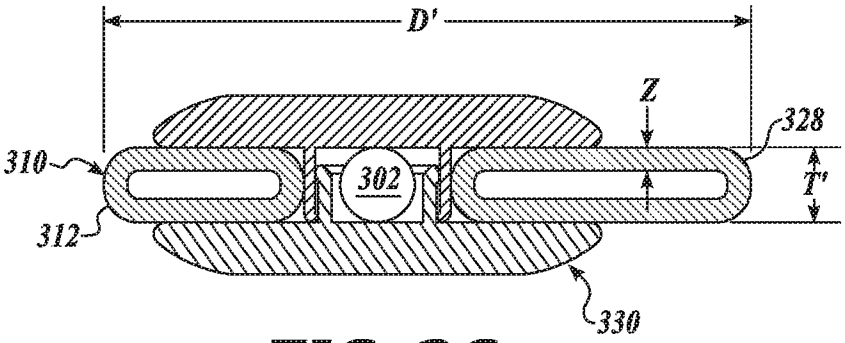
FIG. 3C shows a side elevation section view of the cosmetic assembly of FIG. 3A, in a compressed state.
Figure 3D:
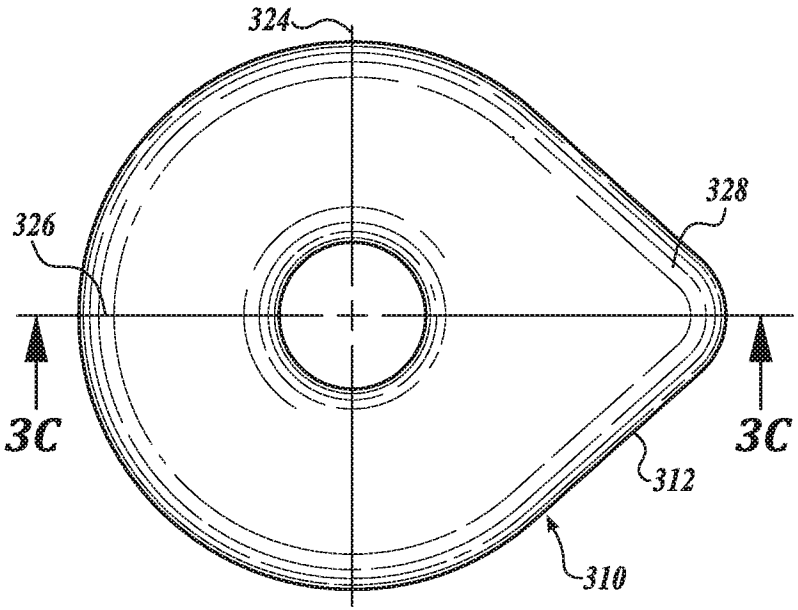
FIG. 3D shows a schematic top plan view of the cosmetic assembly of FIG. 3A, in the compressed state.

FIG. 3A and FIG. 3B show the cosmetic assembly 300 in the resting state, whereas FIG. 3C and FIG. 3D show the cosmetic assembly 300 in the compressed state. In the resting state, the applicator 310 displaces a first volume (i.e., the space enveloped by outer surface 312 occupies the first volume), and in the compressed state, the applicator 310 displaces a second (compressed) volume that is less than the first volume. In the resting state, the applicator 310 has a first outer dimension D and a first thickness T. In the compressed state, the applicator 310 has a second outer dimension D' (which is greater than the first outer dimension D) and a second thickness T' (which is less than the first thickness T). The material properties and/or construction of the applicator 310 bias the applicator 310 (and therefore the cosmetic assembly 300) to the resting state.

Unlike the applicator 110 of FIG. 1, the applicator 310 of FIG. 3A-FIG. 3D includes an asymmetrical portion 328 that forms an asymmetrical protrusion when the cosmetic assembly 300 is in the compressed state. Restated, in the resting state, the applicator 310 is relatively symmetrical in the first radially outward direction 324 and the second radially outward direction 326 of FIG. 3B (which are for reference only). However, in the compressed state, pressure exerted on the applicator 310 by the actuator 330 causes the asymmetrical portion 328 of the applicator 310 to expand in the second radially outward direction 326 by a disproportionately large distance relative to one or more other portions of the applicator 310. The asymmetrical portion 328 advantageously provides a precise applicator well-suited to applying formulation a skin-portion, e.g., for blending eye makeup on an eye skin portion. To effectuate this disproportional expansion, in some embodiments the asymmetrical portion 328 is constructed with a different material composition than other portions of the applicator 310. In some embodiments, the asymmetrical portion 328 has one or more mechanical features (e.g., a thinner wall thickness t' as shown in FIG. 3C) that facilitate its disproportional expansion. In some embodiments, the applicator 310 includes more than one asymmetrical portion 328, each of which extends radially outwardly in different directions and, in some embodiments, by different distances.

In addition, the cosmetic assembly 300 includes an optional formulation 302, which in this representative embodiment, is provided as a formulation-containing vessel stored within the actuator 330. In some embodiments, such a vessel is "activated" by actuating the actuator 330 from the resting state to the compressed state. In some embodiments, such a vessel is replaceable, e.g., as a consumable unit.

FIG. 4A-FIG. 4D show another representative cosmetic assembly 400 formed in accordance with the present disclosure. The cosmetic assembly 400 has similar features as the cosmetic assembly 100 and cosmetic assembly 300, i.e., it has an applicator 410 positioned within an actuator 430 that is configured to actuate the applicator 410 between a resting state and a compressed state. Further, the applicator 410 is provided with two grasping surfaces 438 to facilitate use. Further, the cosmetic assembly 400 is provided with an optional formulation 402 (e.g., a vessel containing a dry powder formulation).

The cosmetic assembly 400 differs in at least two respects. First, the actuator 430 has single-part construction, rather than an assembly of a plurality of actuator parts. In some embodiments, the actuator 430 is formed as a single molded part. In some embodiments, the actuator 430 is initially formed as two or more actuator parts, which are subsequently joined together (e.g., through ultrasonic welding) to form a single part. In the illustrated embodiment, the two grasping surfaces 438 are connected by an integrally-formed offset connector 440 that is configured to apply enough force to the applicator 410 in the resting state to hold the cosmetic assembly 400 together (i.e., to hold the applicator 410 within the actuator 430). In the illustrated embodiment, the offset connector 440 is an offset hinge. In some embodiments, the offset connector 440 is a spring, clamp, wire, or other connecting point that is offset from a center of the application of force (e.g., from a center of the actuator 430). Restated, the offset connector 440 is located around a perimeter of the actuator 430. In some embodiments, the offset connector 440 is provided with a mechanism configured that enables the actuator 430 to apply varying degrees of constant force to the applicator 410 (such as a torsion spring).

A second distinction is that the applicator 410 does not have a hole therethrough, but rather has a relatively flat, "pancake" like shape. Like the applicator 110 of applicator 310 previously described, the applicator 410 has a single, contiguous air chamber 414; however, in some embodiments, the applicator 410 is substantially solid or has two or more distinct air chambers 414. The material properties and/or construction of the applicator 410 bias the applicator 410 (and the cosmetic assembly 400) toward the resting state.

Figure 4A:
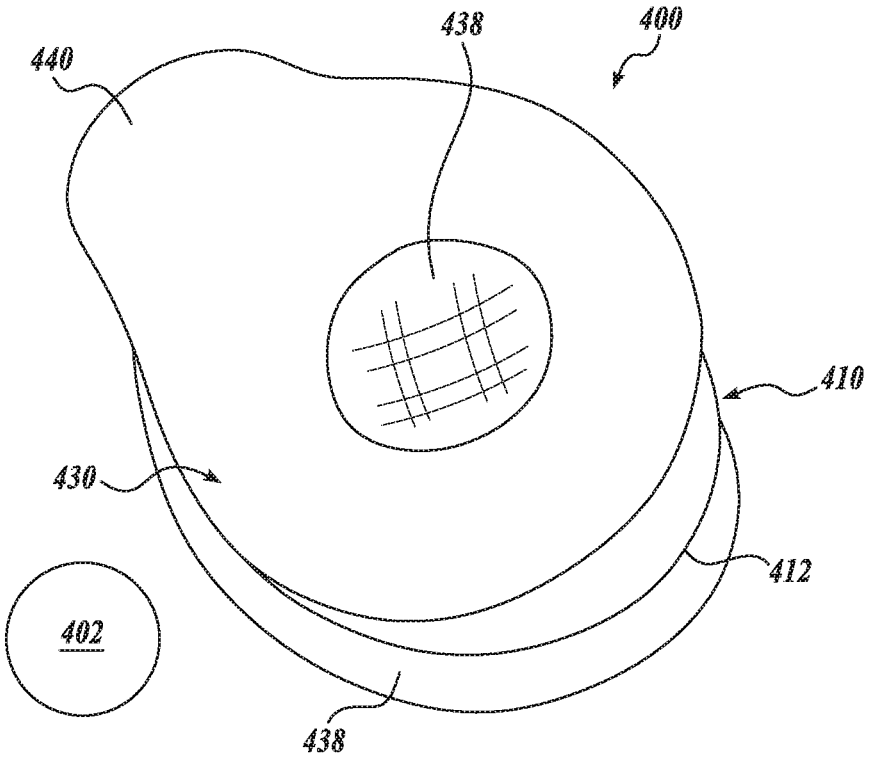
FIG. 4A shows an upper perspective view of a cosmetic assembly in accordance with still another representative embodiment of the present disclosure, in a resting state.
Figure 4B:
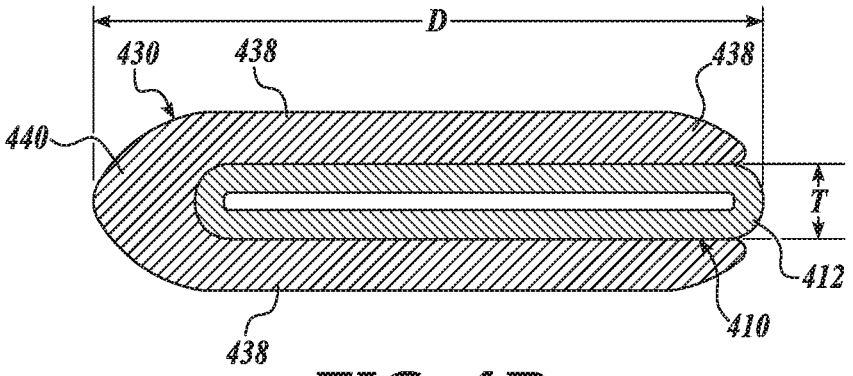
FIG. 4B shows a side elevation section view of the cosmetic assembly of FIG. 4A, in the resting state.
Figure 4C:
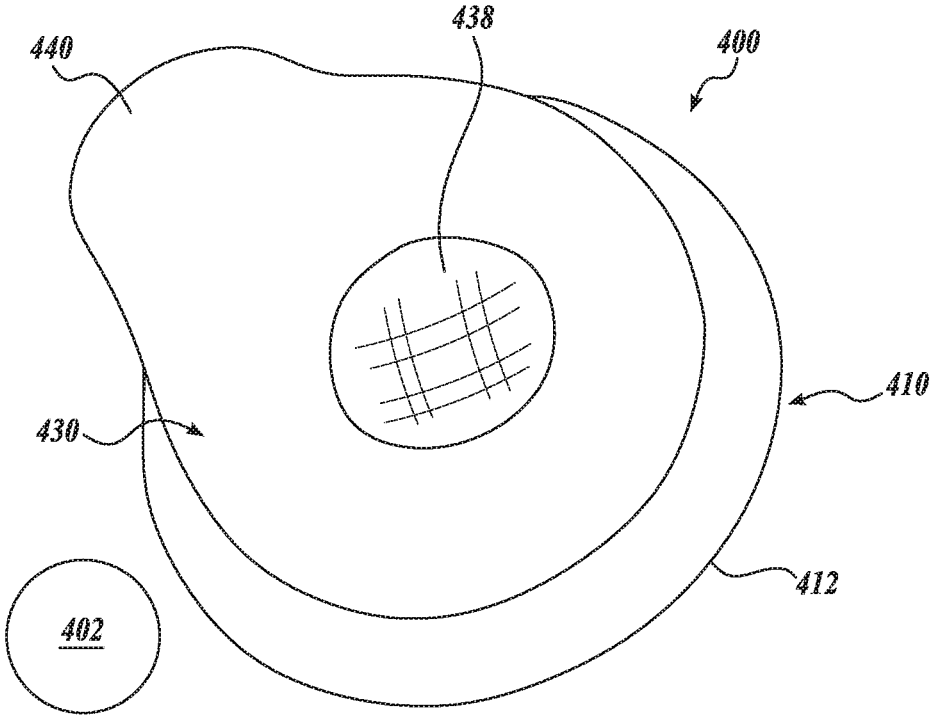
FIG. 4C shows an upper perspective view of the cosmetic assembly of FIG. 4A, in a compressed state.
Figure 4D:
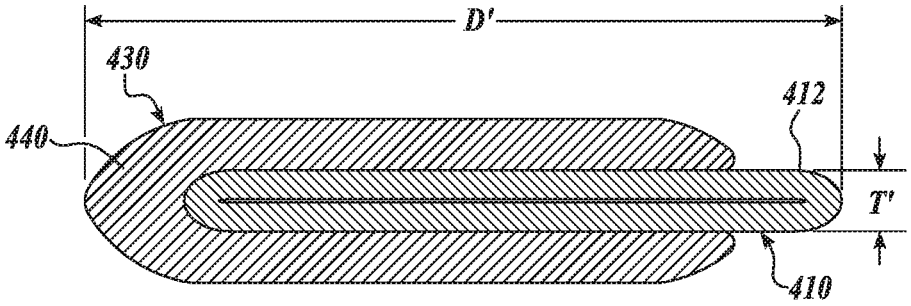
FIG. 4D shows a side elevation section view of the cosmetic assembly of FIG. 4A, in the compressed state.

FIG. 4A and FIG. 4B show the cosmetic assembly 400 in the resting state, whereas FIG. 4C and FIG. 4D show the cosmetic assembly 400 in the compressed state. In the resting state, the applicator 410 displaces a first volume (i.e., the space enveloped by outer surface 412 occupies the first volume), and in the compressed state, the applicator 410 displaces a second (compressed) volume that is less than the first volume. Further, in the resting state, the applicator 410 has a first outer dimension D and a first thickness T. In the compressed state, the applicator 410 has a second outer dimension D' (which is greater than the first outer dimension D) and a second thickness T' (which is less than the first thickness T). The pressure within the air chamber 414 biases the applicator 410 (and therefore the cosmetic assembly 400) toward the resting state shown in FIG. 4A and FIG. 4B, in which the applicator 410 is largely concealed by the actuator 430. That is, in the resting state, the applicator 410 is at least partially tucked into the actuator 530, such that it remains clean and away from unwanted marking/touching of other surfaces. This biasing also advantageously provided tactile feedback to the user. In some embodiments, the applicator 410 has a non-circular shape, and may include any one or more of the features described above, e.g., an asymmetrical portion as described with respect to asymmetrical portion 328.

Figure 5A:
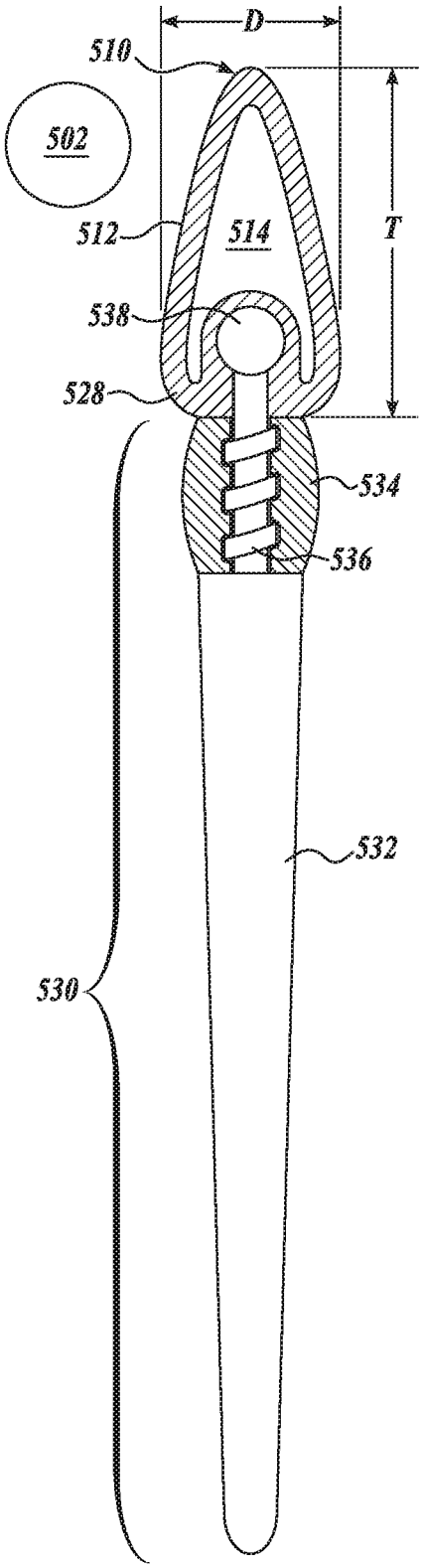
FIG. 5A shows a side elevation section view of a cosmetic assembly in accordance with still another representative embodiment of the present disclosure, in a resting state.
Figure 5B:
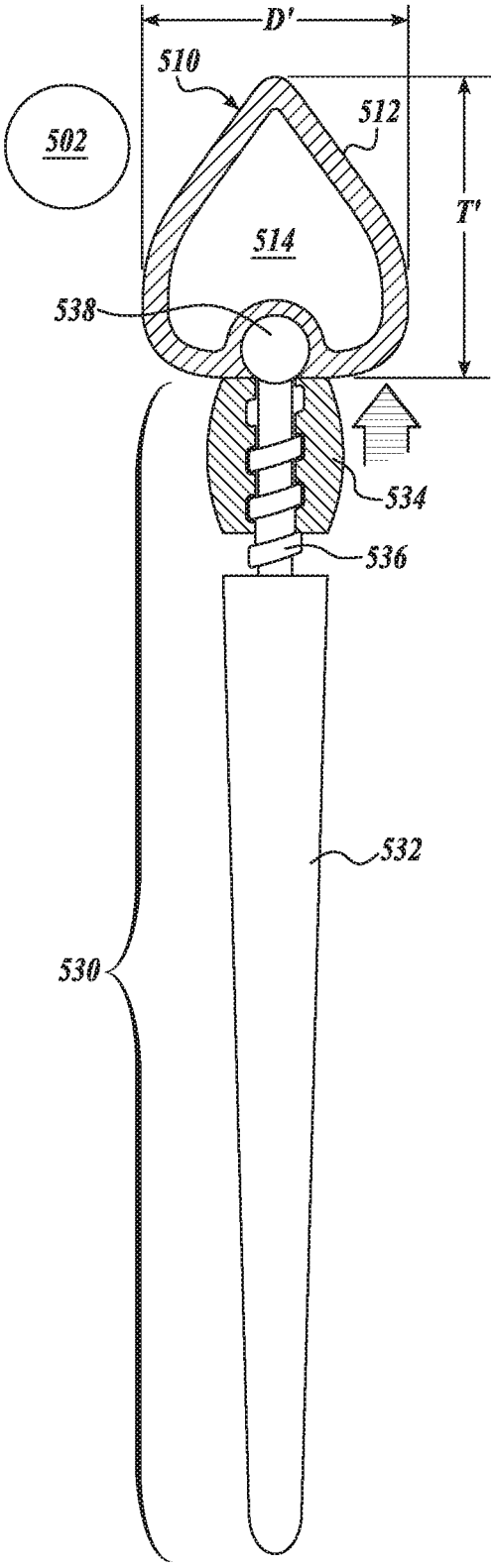
FIG. 5B shows a side elevation section view of the cosmetic assembly of FIG. 5A, in a compressed state.

FIG. 5A and FIG. 5B show another representative cosmetic assembly 500 formed in accordance with the present disclosure. The cosmetic assembly 500 has similar features as the cosmetic assembly 100, cosmetic assembly 300, and cosmetic assembly 400 i.e., it has an applicator 510 movably connected to an actuator 530 that is configured to actuate the applicator 510 between a resting state (FIG. 5A) and a compressed state (FIG. 5B). Further, the cosmetic assembly 500 is provided with an optional formulation 502 (e.g., a vessel containing a liquid formulation).

The applicator 510 is substantially hollow and has an air chamber 514; however, in some embodiments, the applicator 510 is substantially solid or has two or more air chambers 514. The applicator 510 is asymmetrical in the resting state (e.g., in this embodiment, the applicator 510 tapers to a pointed tip). In some embodiments, the applicator 510 is substantially flat. The material properties and construction of applicator 510 bias it toward the resting state; however, the actuator 530 is configured such that the cosmetic assembly 500 can be held indefinitely in the resting state, the compressed state, or in any position in between.

Unlike the previously-described cosmetic assemblies, the actuator 530 of the cosmetic assembly 500 acts on the applicator 510 utilizing a threaded mechanism that includes a collet 534 threadably engaged with a threaded portion 536 that is attached to the end of a handle 532, such as the handle of a makeup brush, a pen, a painter's brush, or a similar ergonomic interface. A base portion 528 of the applicator 510 connects to an anchor portion 538 of the threaded portion 536.

Thus, rather than compressing the applicator 510 from opposite sides (as with the actuators of the previously-described embodiments), the actuator 530 compresses the applicator 510 by pushing the collet 534 linearly against the base portion 528 of the applicator 510, which causes the applicator 510 to compress in a longitudinal direction of the threaded portion 536 (a longitudinal direction of the handle 532), and to expand in one or more other directions. Advantageously, the threaded mechanism enables a user to apply and set a varying force to the base portion 528 of the applicator 510, in order to achieve varying levels of expansion along the continuum between the resting state and the compressed state.

In this illustrated embodiment, the applicator 510 expands in at least one direction perpendicular to the longitudinal direction of the handle 532. In the resting state, the applicator 510 displaces a first volume (i.e., the space enveloped by outer surface 512 occupies the first volume), and in the compressed state, the applicator 510 displaces a second (compressed) volume that is less than the first volume. Further, in the resting state of FIG. 5A, the applicator 510 has a first outer dimension D and a first thickness T. In the compressed state of FIG. 5B, the applicator 510 has a second outer dimension D' (which is greater than the first outer dimension D) and a second thickness T' (which is less than the first thickness T).

In some embodiments, friction between the collet 534 and threaded portion 536 operate to set the cosmetic assembly 500 in the compressed state. This advantageously enables a user to utilize the cosmetic assembly 500 in the compressed state without the need to continuously exert a force on the actuator 530.

In some embodiments, the cosmetic assembly 500 is provided with interchangeable applicators 510 for different application. For example, in some embodiments the cosmetic assembly 500 is provided with a first applicator 510 as shown, and a second applicator 510 having a flat edge. In some embodiments, the handle 532 is provided with an actuator 530 and applicator 510 on both ends. In such embodiments, a first applicator 510 on a first end of the handle 532 can differ from a second applicator 510 provided on a second end of the handle 532.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

What is claimed is:

1. A cosmetic assembly movable between a resting state and a compressed state, the cosmetic assembly comprising:

an applicator at least partially formed of a compressible material that is biased toward the resting state, wherein the applicator has a hole therethrough, a first side normal to the hole, and a second side normal to the hole and opposite from the first side; and an actuator configured to actuate the applicator between the resting state and the compressed state, wherein the actuator includes a first part touching the first side of the applicator around the hole, the first part extending greater in a radial direction than an axial direction, the first part including a piston sleeve passing through the hole in the applicator, and the actuator includes a second part touching the second side of the applicator around the hole, the second part extending greater in the radial direction than the axial direction, the second part including a piston that slides within the piston sleeve in a linear axial direction, the applicator has a first volume and a first outer dimension in one direction of the outer surfaces in the resting state, the applicator has a second volume that is less than the first volume and a second outer dimension in the one direction of the outer surfaces exceeds the first outer dimension in the compressed state.

2. The cosmetic assembly of claim 1, wherein the actuator is configured to compress the applicator between two grasping surfaces.

3. The cosmetic assembly of claim 1, wherein the applicator has a toroidal shape.

4. The cosmetic assembly of claim 1, wherein the applicator is substantially solid.

5. The cosmetic assembly of claim 1, wherein the applicator is substantially hollow and includes at least one air chamber.

6. The cosmetic assembly of claim 1, wherein the applicator has an outer shape that is multi-lobal, elliptical, oval, circular, crescent-shaped, rectangular, hexagonal, or octagonal.

7. The cosmetic assembly of claim 4, wherein the compressible material includes at least one material selected from: a thermoset plastic, a silicone, a rubber, a thermoplastic elastomer, a thermoplastic vulcanizate, a thermoplastic urethane, or a gel based polymer.

8. The cosmetic assembly of claim 1, wherein an internal volume of the applicator is sealed.

9. The cosmetic assembly of claim 1, further comprising a formulation.

* * * * *